United States Patent [19]

Johnson

[11] Patent Number: 4,787,306

[45] Date of Patent: Nov. 29, 1988

[54] EGG SHELLING DEVICE

[76] Inventor: Gladys E. Johnson, P.O. Box 1343, Hughson, Calif. 95326

[21] Appl. No.: 143,291

[22] Filed: Jan. 11, 1988

Related U.S. Application Data

[63] Continuation of Ser. No. 012,435, Feb. 9, 1987, abandoned.

[51] Int. Cl.[4] ..... A47J 43/14

[52] U.S. Cl. ..... 99/568; 30/120.1; 99/571

[58] Field of Search ..... 99/516, 534, 536, 568, 99/571, 537; 30/120.1

[56] References Cited

U.S. PATENT DOCUMENTS 1,618,682 2/1927 Snapp ..... 99/568 X 2,424,425 7/1947 Yates ..... 99/516

*Primary Examiner*—Timothy F. Simone

*Attorney, Agent, or Firm*—George M. Cole

[57] ABSTRACT

Egg shelling device (A) having a tubular body member (A) with an upper end (B) that is adapted to be slipped onto the end of a faucet (C). The body member (A) includes interior passages (I,E,7) and includes a conical seat edge (G) which is radially inwardly projecting so that a hard boiled egg (H) when seated against the seat edge prevents the water pressure from acting on the outside of the egg shell (3). The water pressure entering the interior of the egg at broken portion (5) expels the egg.

3 Claims, 1 Drawing Sheet

EGG SHELLING DEVICE

This application is a continuation, of application Ser. No. 012,435, filed Feb. 9, 1987, now abandoned.

DESCRIPTION

TECHNICAL FIELD

The invention relates to improvements in an egg shelling device and more particularly to a device for attachment to a faucet or tap to utilize water pressure for shelling of a hard boiled egg.

BACKGROUND ART

It is well known that shelling hard boiled eggs is a tedious task, one which requires time and patience of the person doing the peeling. Efforts have been directed to simple kitchen faucet attachments to make the task easier and faster. Such attempts have been largely unsuccessful because the devices have been awkward, complicated and expensive. Also they create more problems than they solve since they simply do not function as intended.

Typical prior art devices comprise an attachment which has a flared cup portion for receiving the end of a hard boiled egg. However, when this type of sheller is used it is found that the water pressure exerted on the inside of the egg shell equals the water pressure exerted on the outside of the egg with the result that the dual pressures balance each other and the egg merely acts as a plug for closing off the flared lower end of the shelling device. One consequence is that water sprays outward on the user frequently.

U.S. Pat. No. 4,056,051 issued Nov. 1, 1977 is representative of a prior art device that does not function as intended inasmuch as the water pressure applied is equal on both the outside and inside and thus the egg acts as a plug. Thus water will spray outwardly from around the lower end of the skirt portion of the apparatus and still not force the egg out of the shell. The only other known prior art which is of interest but which is not pertinent includes U.S. Pat. Nos. 1,618,682; 2,424,425; 2,962,067; and 3,951,055.

DISCLOSURE OF THE INVENTION

The invention comprises a single flexible member which friction fits on the end of a faucet. A central inside cavity leads from the top downwardly through the device to an annular interior seat of smaller diameter than the inside of the body of the device at the lower end. The lower end of the device flares outwardly past the seat to form a depending annular skirt portion. An interior seat above the lower end of the skirt forces any spray to be directed downwardly and also presents equalization of water pressure on the inside and outside of the egg.

Accordingly it is among the features of the invention to provide a uniquely simple, inexpensive, flexible rubber or plastic body which is formed into a single body or member. The device is durable and is quickly slipped on to and detached from a faucet. It sheds the shell from the egg itself quickly, efficiently and without spraying water.

BEST MODE FOR CARRYING OUT THE INVENTION

Figure 1:
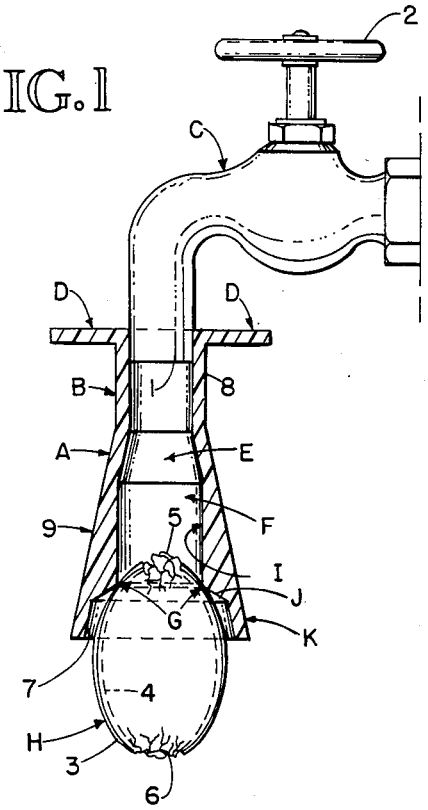
FIG. 1 is a vertical cross section view through the shelling device of this invention showing it attached to a faucet.

Referring now to the drawings it will be seen that the egg sheller of this invention is preferably molded in one piece and can be made from rubber or from material that is semi-flexible or resilient after the plastic has set. The egg sheller is indicated generally at A in the three figures of the drawings. The device has a tubular upper portion B that has sufficient elasticity to be pulled up onto the outlet end 1 of a conventional water faucet C. The egg sheller A has integral tabs or ears D that project radially from the top of the device. The operator grasps these tabs when slipping the top tubular portion B onto the outlet end 1 of the water faucet. The device is frictionally held in place even when the faucet handle 2 is opened for causing water under pressure to enter the tubular portion B for removing the egg from its shell in a manner hereinafter explained.

The sectional view of the egg sheller in FIG. 1 shows the tubular upper portion B communicating with an outwardly flared passage E. The flared interior passage portion E in turn communicates with a cylindrical passage F defined by interior surface I that leads to annular seat or edge G against which the smaller end of a hard boiled egg H is held. The thickness of the egg shell 3 in FIG. 1 is indicated by the oval row of dotted lines that parallel the oval outline of the egg H. The inner dotted lines 4 indicate the membrane of the egg. Both the shell 3 and the membrane 4 of the egg are broken at each end as 5 and 6. The break 5 at the upper end lies within the annular seat edge G. The seat is conically shaped and the surface J thereof preferably makes an angle of about 45 degrees with the longitudinal axis of the sheller body.

Figure 3:
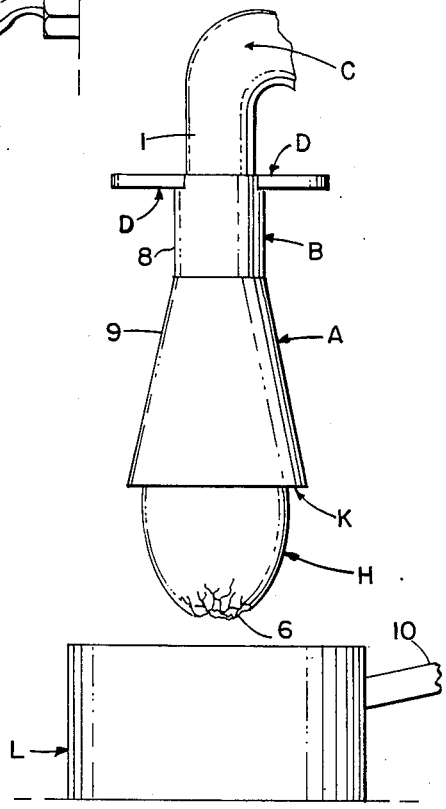
FIG. 3 is a side elevation view of the invention showing its appearance from the outside thereof and including a receptacle for catching the expelled egg.
Figure 2:
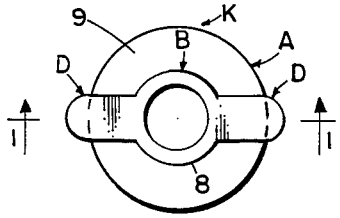
FIG. 2 is a top plan view of the device of this invention.

The inwardly and upwardly angled or flared conical surface J, as seen in FIG. 1, communicates with interior surface I of passage F to form the annular seat edge G. An annular integral skirt portion K of the device extends below the conical portion J. The inwardly flared surface J extends inwardly away from the egg and intersects with the inner surface 7 of the skirt portion K away from the outer surface of the egg shell. This leaves an annular interior space between the surface of the egg shell on the one hand and wall surface 7 of the skirt and surface J on the other hand. The side elevation of the egg shelling device in FIG. 3 shows the outer surface 8 of the tubular upper portion B as being cylindrical and the remaining outer surface 9 as being conical. The precise outside or outer configuration is not critical so long as the interior design is adhered to.

As already stated, the egg shelling device in operation is first pulled onto the outlet end 1 of the faucet C by diametrically opposed tabs D as seen in the drawings. The hard boiled egg H is broken at both ends and the broken portions 5 and 6 will extend through both the shell 3 and membrane 4.

A receptacle L such as a pan with handle 10 is placed under faucet C. The operator encircles the egg H with her hand and fingers and holds the smaller end of the egg against the conical seat G. This places the broken area 5 in communication with the cylindrical passage F. Care is taken by the operator to keep free the lower end of the egg so that when the water is turned on the pressure of the water within the egg shell can expel the egg through the cracked area 6 which of course will be enlarged by the egg passing out of the shell through the broken area.

When the operator holds the small end of the egg against the seat edge G and turns on the water for a moment, the pressure of the water will cause it to enter the egg shell 3 and membrane 4 at broken area 5 and exert its full force on the hard boiled egg inside. The water will tend to flow between the membrane 4 and the egg for loosening the egg from the membrane and shell and then the pressure of the water is sufficient to force the egg out through broken area 6 and allow it to drop into pan L. The seat edge G prevents any water pressure from building up on the outer surface of the egg shell to counterbalance the water pressure exerted inside.

The action of the water pressure to expel the egg is quite rapid if not almost instantaneous. The faucet can be quickly shut off, but even with the momentary delay in shutting off the water the skirt K prevents any water from splashing laterally outwardly on the operator. Thus the water is directed downwardly.

I claim:

1. An egg shelling device, comprising:

(a) a tubular member having an upper end adapted to be removably attached to a water faucet and having a passage for receiving the flow of water from the faucet when the faucet valve is opened and also having a lower end of larger diameter than said upper end;

(b) said tubular member near its lower end having a first surface comprising a portion of said passage communicating with a second outwardly angling surface to define an edge seat to receive the small end of an egg to establish an annular edge line contact between said edge seat and said egg, said second outwardly angling surface extending outwardly at an angle so as to be spaced from an egg held against said edge seat and such that it joins with the inner surface of a skirt formed integrally with said tubular member and extending downwardly to define an interior third surface also spaced from an egg held against said seat edge.

2. The egg shelling device according to claim 1 and wherein said tubular member has diametrically opposed and outwardly extending integral tabs located adjacent to the end of said member that can be removably secured to the water faucet, said tabs being manually grasped for aiding in connecting the device to the water faucet.

3. The egg shelling device according to claim 1 and wherein the diameter of the annular seat edge is smaller than the diameter of the inner surface of the annular skirt so as to direct water pressure into a small opening formed in the egg shell at the upper end thereof and to prevent any water pressure from building up on any portion of the outer surface of the egg shell that is below said seat edge.

* * * * *